US008431072B2

(12) United States Patent
Muralidharan et al.

(10) Patent No.: US 8,431,072 B2
(45) **Date of Patent: *Apr. 30, 2013**

(54) CAST ALUMINA FORMING AUSTENITIC STAINLESS STEELS

(75) Inventors: Govindarajan Muralidharan, Knoxville, TN (US); Yukinori Yamamoto, Oak Ridge, TN (US); Michael P. Brady, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/114,745

(22) Filed: May 24, 2011

(65) Prior Publication Data

US 2012/0301347 A1 Nov. 29, 2012

(51) Int. Cl.
*C22C 38/54* (2006.01)
*C22C 38/58* (2006.01)
*C22C 38/06* (2006.01)

(52) U.S. Cl.
USPC ..... 420/43; 420/44; 420/45; 420/46; 420/47; 420/54; 420/55; 420/62; 420/63; 420/79; 420/80; 420/584.1

(58) Field of Classification Search ..... 420/584.1, 420/79, 80.62, 43, 54, 55; 148/327
See application file for complete search history.

(56) References Cited

U.S. PATENT DOCUMENTS

| | | | | |
|---|---|---|---|---|
| 3,754,898 | A * | 8/1973 | McGurty | 420/40 |
| 4,086,085 | A * | 4/1978 | McGurty | 420/43 |
| 7,744,813 | B2 * | 6/2010 | Brady et al. | 420/34 |
| 7,754,144 | B2 * | 7/2010 | Brady et al. | 420/49 |
| 7,754,305 | B2 * | 7/2010 | Yamamoto et al. | 428/49 |

* cited by examiner

*Primary Examiner* — Deborah Yee
(74) *Attorney, Agent, or Firm* — Novak Druce Connolly Bove + Quigg LLP

(57) ABSTRACT

An austenitic stainless steel alloy consisting essentially of, in terms of weight percent ranges 0.15-0.5C; 8-37Ni; 10-25Cr; 2.5-5Al; greater than 0.6, up to 2.5 total of at least one element selected from the group consisting of Nb and Ta; up to 3Mo; up to 3Co; up to 1W; up to 3Cu; up to 15Mn; up to 2Si; up to 0.15B; up to 0.05P; up to 1 total of at least one element selected from the group consisting of Y, La, Ce, Hf, and Zr; <0.3Ti+V; <0.03N; and, balance Fe, where the weight percent Fe is greater than the weight percent Ni, and wherein the alloy forms an external continuous scale comprising alumina, and a stable essentially single phase FCC austenitic matrix microstructure, the austenitic matrix being essentially delta-ferrite free and essentially BCC-phase-free. A method of making austenitic stainless steel alloys is also disclosed.

15 Claims, 5 Drawing Sheets

Oxidation behavior at 800°C in air with 10% water vapor (100 h cycles)

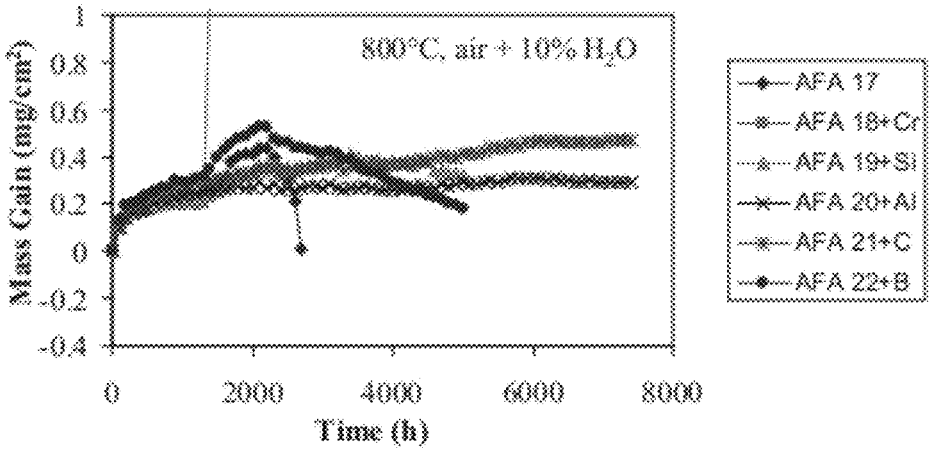
Fig. 1- Oxidation behavior at 800°C in air with 10% water vapor (100 h cycles)
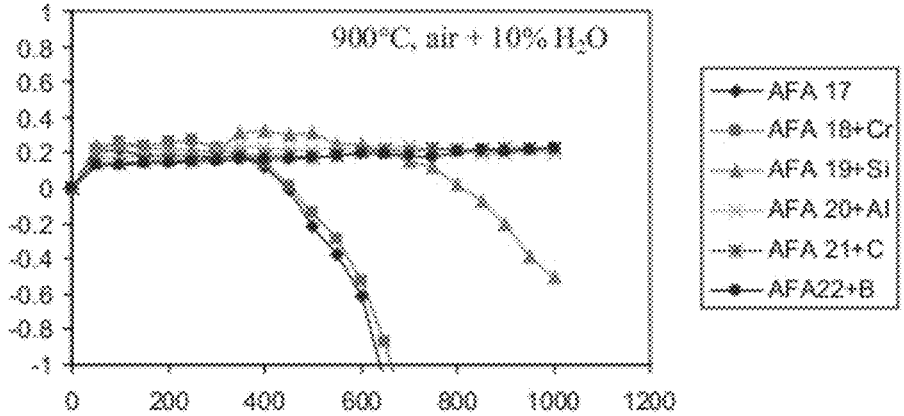
Fig. 2- Oxidation behavior at 900°C in air with 10% water vapor (10 h cycles).

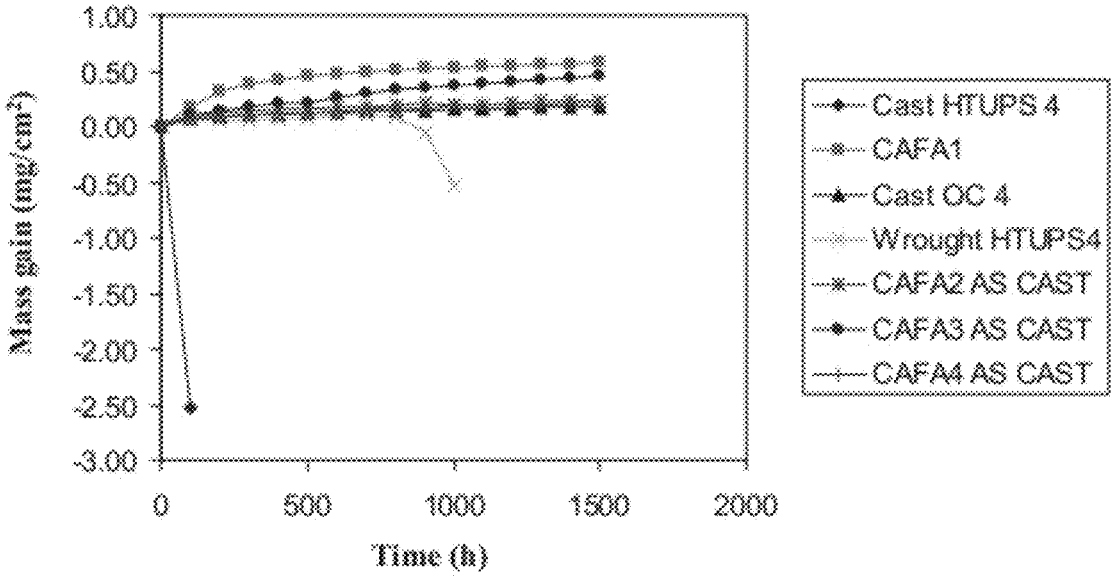
Fig. 3- Oxidation behavior at 800°C in air with 10% water vapor

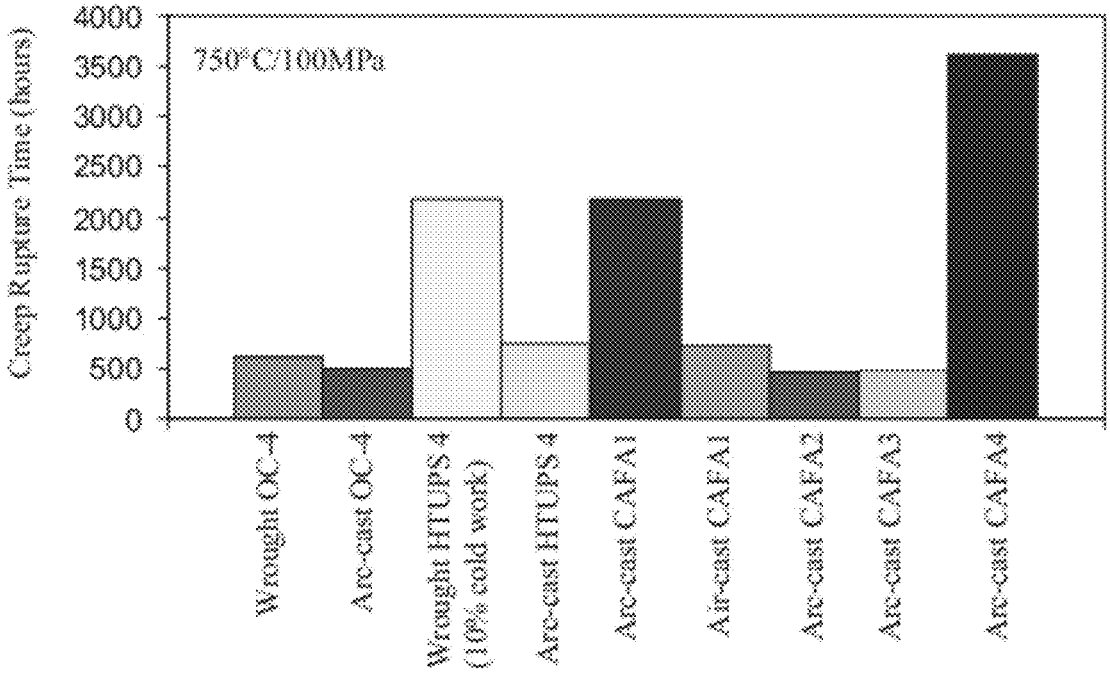
Fig. 4- Creep Rupture life at 750°C and 100 MPa.

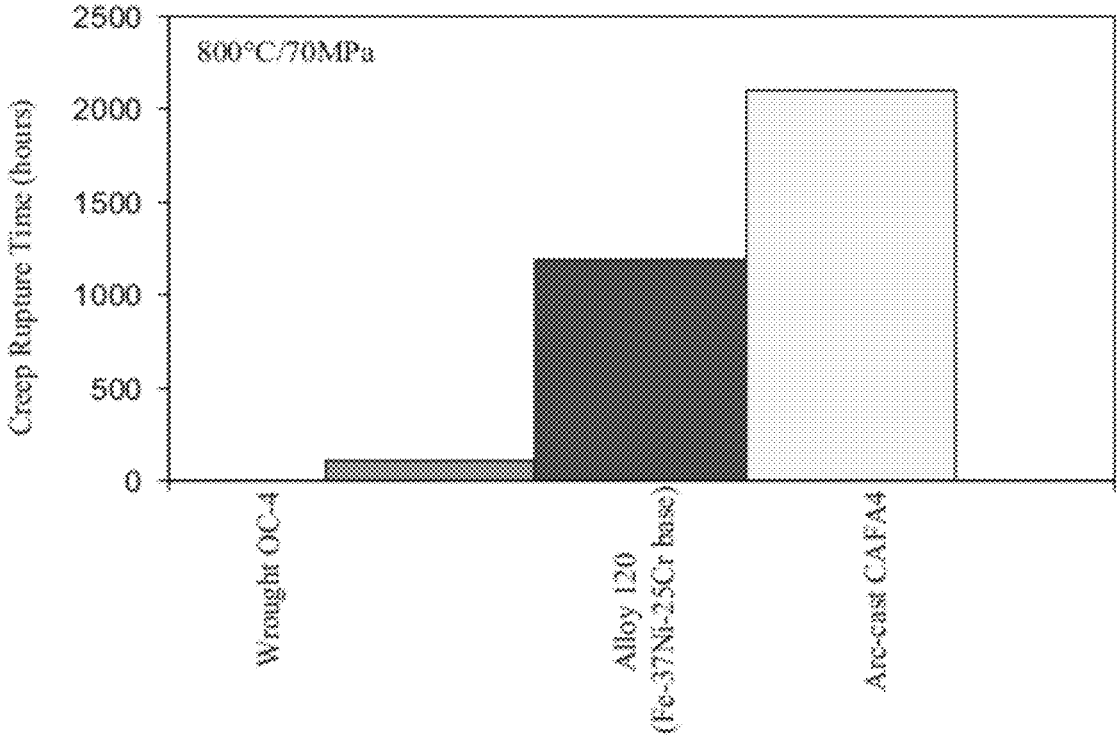
Fig. 5- Creep Rupture life at 800°C and 70 MPa.

Table 1- Nominal alloy compositions in weight percent of AFA study of the effects of Al, B, Si, C level on oxidation, Alloy balance is iron (Fe).

| Alloy | Ni | Cr | Al | Nb | Mn | Mo | Si | C | B | other |
|---|---|---|---|---|---|---|---|---|---|---|
| AFA 17 base | 25.2 | 14.9 | 3.0 | 2.5 | 1.9 | 2.0 | 0.15 | 0.09 | 0.01 | 0.009Y 0.13Hf |
| AFA 18+Cr | 25.2 | 16.9 | 3.0 | 2.5 | 1.9 | 2.0 | 0.15 | 0.10 | 0.008 | 0.011Y 0.13Hf |
| AFA 19+Si | 25.1 | 15 | 3.0 | 2.5 | 1.9 | 2.0 | 0.4 | 0.09 | 0.007 | 0.006Y 0.14Hf |
| AFA 20 +Al | 25.1 | 14.9 | 4.0 | 2.5 | 1.9 | 2.0 | 0.15 | 0.09 | 0.011 | 0.009Y 0.14Hf |
| AFA21 +C | 25.2 | 14.9 | 3.0 | 2.5 | 1.9 | 2.0 | 0.15 | 0.20 | 0.012 | 0.014Y 0.014Hf |
| AFA22 +B | 25.2 | 14.9 | 3.0 | 2.5 | 1.9 | 2.0 | 0.15 | 0.10 | 0.107 | 0.008Y 0.14Hf |

Fig. 6

Table 2- Nominal alloy compositions in weight percent of existing and new developmental AFA alloys suitable for casting. Alloy balance is iron (Fe).

| Composition (wt%) | | | | | | | | | | | | | | |
|---|---|---|---|---|---|---|---|---|---|---|---|---|---|---|
| Alloy | Cr | Mn | Ni | Cu | Al | Si | Nb | V | Ti | Mo | W | C | B | P |
| CAFA1 | 14 | 2 | 25 | 0.5 | 3.5 | 1 | 0.95 | 0.05 | 0.05 | 2 | 1 | 0.2 | 0.01 | 0.02 |
| CAFA2 | 14 | 2 | 25 | 0.5 | 3.5 | 1 | 2.50 | 0.05 | 0.05 | 2 | 1 | 0.2 | 0.01 | 0.02 |
| CAFA3 | 14 | 2 | 25 | 0.5 | 3.5 | 2 | 0.95 | 0.05 | 0.05 | 2 | 1 | 0.2 | 0.01 | 0.02 |
| CAFA4 | 14 | 2 | 25 | 0.5 | 3.5 | 1 | 0.95 | 0.05 | 0.05 | 2 | 1 | 0.3 | 0.01 | 0.02 |
| CAFA 5 | 14 | 2 | 25 | 0.5 | 3.5 | 1 | 0.95 | 0.05 | 0.05 | 2 | 1 | 0.4 | 0.01 | 0.02 |
| CAFA 6 | 14 | 2 | 25 | 0.5 | 3.5 | 1 | 0.95 | 0.05 | 0.05 | 2 | 1 | 0.5 | 0.01 | 0.02 |
| AF cast CAFA1 | Adds 0.0125 wt.% N | | | | | | | | | | | | | |
| | | | | | | | | | | | | | | |
| HYUPS 8 | 14 | 2 | 20 | | 2.5 | 0.15 | 0.95 | | | 2.5 | | 0.08 | 0.01 | 0.02 |

Fig. 7

CAST ALUMINA FORMING AUSTENITIC STAINLESS STEELS

STATEMENT AS TO FEDERALLY SPONSORED RESEARCH

This invention was made with government support under DE-AC05-00OR22725 awarded by the United States Department of Energy. The government has certain rights in the invention.

FIELD OF THE INVENTION

This invention relates generally to alumina forming austenitic (AFA) stainless steels, and more particularly to AFA stainless steels that are useful for casting processes.

BACKGROUND

Alumina-forming austenitic (AFA) stainless steels are a new class of high-temperature (600-900° C.; 1112-1652° F.) structural alloy steels with a wide range of energy production, chemical/petrochemical, and process industry applications. Examples of such steels can be found in United States patents including U.S. Pat. No. 7,744,813, U.S. Pat. No. 7,754,144, and U.S. Pat. No. 7,754,305, the disclosures of which are incorporated fully by reference. These steels combine the relatively low cost, excellent formability, weldability, and good high-temperature creep strength (resistance to sagging over time) of state-of-the-art advanced austenitic stainless steels with fundamentally superior high-temperature oxidation (corrosion) resistance clue to their ability to form protective aluminum oxide (alumina, $Al_2O_3$) surface layers. Conventional high-temperature stainless steels rely on chromium-oxide (chromia, $Cr_2O_3$) surface layers for protection from high-temperature oxidation. However, compromised oxidation resistance of chromia in the presence of aggressive species such as water vapor, carbon, sulfur, and the like typically encountered in energy production and process environments necessitates a reduction in operating temperature to achieve component durability targets. This temperature reduction reduces process efficiency and increases environmental emissions.

Alumina grows at a rate 1 to 2 orders of magnitude lower than chromia and is also significantly more thermodynamically stable in oxygen, which results in its fundamentally superior high-temperature oxidation resistance. A further, key advantage of alumina over chromia is its greater stability in the presence of water vapor. Water vapor is encountered in most high-temperature industrial environments, ranging, for example, from gas turbines, combustion, and fossil-fired steam plants to solid oxide fuel cells. With both oxygen and water vapor present, volatile chromium oxy-hydroxide species can form and significantly reduce oxidation lifetime, necessitating significantly lower operating temperatures. This results in reduced process efficiency and increased emissions.

To date AFA alloy development has focused on wrought material forms (plate, sheet, foil, and tubes). However, many applications require complicated component shapes best achieved by casting (engine and turbine components). Casting can also result in lower cost tube production methods for chemical/petrochemical and power generation applications.

SUMMARY

An austenitic stainless steel alloy can consist essentially of, in weight percent ranges:

0.15-0.5C;
8-37Ni;
0-25Cr;
2.5-5Al;
greater than 0.6, up to 2.5 total of at least one element selected from the group consisting of Nb and Ta;
up to 3Mo;
up to 3Co;
up to 1W;
up to 3Cu;
up to 15Mn;
up to 2Si;
up to 0.05B;
up to 0.05P;
up to 1 total of at least one element selected from the group consisting of Y, Ce, Hf, and Zr;
<0.3 Ti+V;
<0.03N; and balance Fe.

The weight percent Fe is greater than the weight percent Ni. The alloy forms an external continuous scale comprising alumina, and a stable essentially single phase FCC austenitic matrix microstructure. The austenitic matrix is essentially delta-ferrite free and essentially BCC-phase-free.

The C weight percent range can be 0.2-0.5C or 0.2-0.4C. The Cr weight percent range can be 10-15Cr, or 14-16Cr. The Ni weight percent range can be 15-30Ni or 20-30 Ni. The Mn weight percent range can be 0-5Mn. The Ni weight percent range can be 8-12 Ni and the Mn weight percent range can be 5-15. The Si weight percent range can be up to 1Si. The Nb/Ta weight percent range can be greater than 0.9, up to 2.5 total of at least one element selected from the group consisting of Nb and Ta.

An austenitic stainless steel alloy can consist essentially of, in weight percent ranges:

0.2-0.4C;
23-27Ni;
13-15Cr;
3.0-4Al;
greater than 0.9, up to 1 total of at least one element selected from the group consisting of Nb and Ta;
up to 3Mo;
up to 3Co;
up to 1W;
up to 3Cu;
up to 5Mn;
up to 2Si;
up to 0.15B;
up to 0.05P;
up to 1 total of at least one element selected from the group consisting of Y, La, Ce, Hf, and Zr;
<0.3 Ti+V;
<0.03N; and balance Fe.

The weight percent Fe is greater than the weight percent Ni. The alloy forms an external continuous scale comprising alumina, and a stable essentially single phase FCC austenitic matrix microstructure. The austenitic matrix is essentially delta-ferrite free and essentially BCC-phase-free.

In one aspect, the Ni weight percentage can be about 25Ni, the Cr weight percentage can be about 14Cr, the Al weight percentage can be about 3.5Al, and the Nb/Ta weight percentage can be about 0.95 total of at least one element selected from the group consisting of Nb and Ta.

A method of making stainless steel articles, includes the steps of:

providing, in weight percent ranges:
0.15-0.5C;
8-37Ni;

10-25Cr;

2, 5-5Al;

greater than 0.6, up to 2.5 total of at least one element selected from the group consisting of Nb and Ta;

up to 3Mo;

up to 3Co;

up to 1W;

up to 3Cu;

up to 15Mn;

up to 2Si;

up to 0.15B;

up to 0.05P;

up to 1 total of at least one element selected from the group consisting of Y, La, Ce, Hf, and Zr;

<0.3 Ti+V;

<0.03N; and, balance Fe.

The weight percent Fe is greater than the weight percent Ni. The alloy forms an external continuous scale comprising alumina, and a stable essentially single phase FCC austenitic matrix microstructure. The austenitic matrix is essentially delta-ferrite free and essentially BCC-phase-free. The mixture is heated above the melting point. The mixture is cooled to solidify the mixture to form a solid alloy. The heated mixture can be cast prior to cooling.

BRIEF DESCRIPTION OF THE DRAWINGS

A fuller understanding of the present invention and the features and benefits thereof will be obtained upon review of the following detailed description together with the accompanying drawings, in which:

FIG. 1 is a graph of oxidation behavior at 800° C. in air with 10% water vapor (100 h cycles).

FIG. 2 is a graph of oxidation behavior at 900° C. in air with 10% water vapor (10 h cycles).

FIG. 3 is a graph of oxidation behavior at 800° C. in air with 10% water vapor.

FIG. 4 is a graph of creep rupture life at 750° C. and 100 MPa.

FIG. 5 is a graph of creep rupture life at 800° C. and 70 MPa.

FIG. 6 is a table of nominal alloy compositions in weight percent of AFA study of the effects of Al, B, Si, C level on oxidation. Alloy balance is iron (Fe).

FIG. 7 is a table of nominal alloy compositions in weight percent of existing and new developmental AFA alloys suitable for casting. Alloy balance is iron (Fe).

DETAILED DESCRIPTION

Alumina-forming austenitic (AFA) stainless steels are a class of structural steel alloys which comprise aluminum (Al) at a weight percentage sufficient to form protective aluminum oxide (alumina, $Al_2O_3$) surface layers. Examples of such steels can be found in United States patents including U.S. Pat. No. 7,744,813, U.S. Pat. No. 7,754,144, and U.S. Pat. No. 7,754,305, the disclosures of which are incorporated fully by reference. The external continuous scale comprising alumina does not form at an Al level below about 2 weight percent. At an Al level higher than about 3 to 5 weight percent, the exact transition dependent on level of austenite stabilizing additions such as Ni (e.g. higher Ni can tolerate more Al), a significant bcc phase is formed in the alloy, which compromises the high temperature properties of the alloy such as creep strength. The external alumina scale is continuous at the alloy/scale interface and though $Al_2O_3$ rich the scale can contain some Mn, Cr, Fe and/or other metal additives such that the growth kinetics of the Al rich oxide scale is within the range of that for known alumina scale.

Nitrogen is found in some conventional $Cr_2O_1$-forming grades of austenitic alloys up to about 0.5 wt. % to enhance the strength of the alloy. The nitrogen levels in AFA alloys must be kept as low as possible to avoid detrimental reaction with the Al and achieve alloys which display oxidation resistance and high creep strength at high temperatures. Although processing will generally result in some uptake of N in the alloy, it is necessary to keep the level of N at less than about 0.05 wt %, or less than 0.03 wt %, for the inventive alloy. When N is present, the Al forms internal nitrides, which can compromise the formation of the alumina scale needed for the desired oxidation resistance as well as a good creep resistance.

The addition of Ti and/or V is common to virtually all high-temperature austenitic stainless steels and related alloys to obtain high temperature creep strength, via precipitation of carbide and related phases. To permit the formation of the alloys of the invention and the alumina scale, the composition typically has to include little or no titanium or vanadium, with a combined level of less than about 0.3 weight percent. The addition of Ti and V shifts the oxidation behavior (possibly by increasing oxygen permeability) in the alloy such that Al is internally oxidized, requiring much higher levels of Al to form an external $Al_2O_3$ scale in the presence of Ti and V. At such high levels, the high temperature strength properties of the resulting alloy are compromised by stabilization of the weak bee Fe phase.

Additions of Nb or Ta are necessary for alumina-scale formation. Too much Nb or Ta will negatively affect creep properties by promoting δ-Fe and brittle second phases.

Within the allowable ranges of elements, particularly those of Al, Cr, Ni, Fe, Mn, Mo and, when present Co, W. and Cu, the levels of the elements are adjusted relative to their respective concentrations to achieve a stable fcc austenite phase matrix. The appropriate relative levels of these elements for a composition is readily determined or checked by comparison with commercially available databases or by computational thermodynamic models with the aid of programs such as Thermo-Calc. In the casting of AFA steels, the partitioning of elements during solidification determines composition control. Non-equilibrium phases formed during solidification will modify the type and amount of strengthening phases.

Additionally, up to 3 weight percent Co, up to 3 weight percent Cu, and up to 1 weight percent W can be present in the alloy as desired to enhance specific properties of the alloy. Rare earth and reactive elements, such as Y, La, Ce, Zr, and the like, at a combined level of up to 1 weight percent can be included in the alloy composition as desired to enhance specific properties of the alloy. Other elements can be present as unavoidable impurities at a combined level of less than 1 weight percent.

The C weight percentage can be 0.15-0.5C. The C weight percentage can be 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or 0.50. The C high/low weight percentage range can be any combination of the above. For example the C weight percentage range can be 0.2-0.5, 0.15-0.4, 0.2-0.4, or 0.3-0.5.

The Ni weight percentage is 8-37Ni. The Ni weight percentage can be 8, 9, 10, 11, 12, 13, 14, 15, 16, 17, 18, 19, 20, 21, 22, 23, 24, 25, 26, 27, 28, 29, 30, 31, 32, 33, 34, 35, 36 or 37Ni, The Ni high/low weight percentage range can be any combination of the above. For example, the Ni weight percentage range can be 8-37, 20-37, 8-12, 20-30, or 23-27 Ni.

The Cr weight percent range can be 10-25Cr. The Cr weight percentage can be 10, 11, 12, 13, 14, 15, 16, 17, 18, 19, 20, 21, 22, 23, 24, or 25Cr. The Cr high/low Tight percentage range can be any combination of the above. For example, the Cr range can be 10-15, 13-15, or 14-16Cr.

The Al weight percentage range is 2.5-5Al. The Al weight percentage can be 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0. The Al high/low weight percentage range can be any combination of the above. For example, the Al weight percentage range can be 2.5-5, 3-4, or 3-5.

The Nb/Ta weight percentage is greater than 0.6, up to 2.5 total of at least one element selected from the group consisting of Nb and Ta. The Nb/Ta weight percentage can be 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, or 2.5. The Nb/Ta high/low weight percentage range can be any combination of the above. For example, the Nb/Ta weight percentage range can be 0.6-2.5, 0.9-2.5, or 0.9-1.0 Nb/Ta.

The Mo weight percentage is up to 3Mo. The Mo weight percent can be 0, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0. The Mo high/low weight percentage range can be any combination of the above.

The Co weight percentage is up to 3Co. The Co weight percent can be 0, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0. The Co high/low weight percentage range can be any combination of the above.

The W weight percentage is up to 1W. The W weight percent can be 0, 0.1, 0.2, 0.3, 0.4, 0.5, 0.6, 0.7, 0.8, 0.9, or 1.0. The W high/low weight percentage range can be any combination of the above.

The Cu weight percentage is up to 3Cu. The Cu weight percentage can be 0, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0. The high/low weight percentage range can be any combination of the above.

The Mn weight percentage is up to 15Mn. The Mn weight percentage can be 0, 1, 2, 3, 4, 5, 6, 7, 8, 9, 10, 11, 12, 13, 14, or 15. The Mn high/low weight percentage range can be any combination of the above. For example, the Mn weight percentage range can be 0-5, 5-15, or 3-7.

Silicon can be added to improve fluidity for casting. The Si weight percentage is up to 2Si. The Si weight percent can be 0, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9 or 2.0. The Si high/low weight percentage range can be any combination of the above.

The B weight percentage is up to 0.15B. The B weight percentage can be 0, 0.01, 0.02, 0.03, 0.04, 0.05, 0.06, 0.07, 0.08, 0.09, 0.10, 0.11, 0.12, 0.13, 0.14, or 0.15. The B high/low weight percentage range can be any combination of the above.

The P weight percentage is up to 0.05P. The P weight percentage can be 0, 0.01, 0.02, 0.03, 0.04 or 0.05. The P high/low weight percentage range can be any combination of the above.

The alloys of the invention can comprise up to 1 weight percent total of at least one element selected from the group consisting of Y, La, Ce, Hf, and Zr. The weight percentage of these elements together can be 0, 0.1, 0.2, 0.3, 0.4, 0.5, 0.6, 0.7, 0.8, 0.9, or 1.0. The high/low weight percentage range of these elements can be any combination of the above.

The Ti+V weight percentage is <0.3 Ti+V. The Ti+V weight percentage can be 0.05, 0.10, 0.15, 0.20, 0.25, 0.26, 0.27, 0.28, or 0.29. The Ti+V high/low weight percentage range can be any combination of the above.

The N weight percent range is <0.03N. The N weight percentage can be 0.001, 0.005, 0.010, 0.015, 0.020, 0.025, 0.026, 0.027, 0.028, or 0.029. The N high/low weight percentage range can be any combination of the above.

The balance of the alloy is Fe. The weight percent Fe is greater than the weight percent Ni.

The alloy forms an external continuous scale comprising alumina. The term "continuous" as used herein means that the scale covers at least 75%, 90%, 95%, 96%, 97%, 98%, 99%, 99.5%, or 99.9% of the surface area of the alloy.

The alloy is a stable essentially single phase FCC austenitic matrix microstructure. The austenitic matrix is essentially delta-ferrite free and is essentially BCC-phase-free. The term "essentially delta-ferrite free" as used herein can mean that any delta-ferrite present in the alloy comprises less than, by weight, 10%, 9%, 8%, 7%, 6%, 5%, 4%, 3%, 2%, 1%, 0.5%, 0.1%, or 0.01%, or 0.001% of the alloy. The term "essentially BCC-phase free" as used herein can mean that any BCC-phase present in the alloy comprises less than, by weight, 10%, 9%, 8%, 7%, 6%, 5%, 4%, 3%, 2%, 1%, 0.5%, 0.1%, or 0.01%, or 0.001% of the alloy.

An austenitic stainless steel alloy according to the invention can consist essentially of, in weight percent ranges:

0.15-0.5C;
8-37Ni;
10-25Cr;
2.5-5Al;
greater than 0.6, up to 2.5 total of at least one element selected from the group consisting of Nb and Ta;
up to 3Mo;
up to 3Co;
up to 1W;
up to 3Cu;
up to 15Mn;
up to 2Si;
up to 0.15B;
up to 0.05P;
up to 1 total of at least one element selected from the group consisting of Y, La, Ce, Hf, and Zr;
<03 Ti+V;
<0.03N; and,
balance Fe, wherein the weight percent Fe is greater than the weight percent Ni, and wherein said alloy forms an external continuous scale comprising alumina, and a stable essentially single phase FCC austenitic matrix microstructure, said austenitic matrix being essentially delta-ferrite free and essentially BCC-phase-free.

According to another embodiment of the invention, an austenitic stainless steel alloy consists essentially of, in weight percent ranges:

0.2-0.5C;
20-30Ni;
10-15Cr;
2.5-5Al;
greater than 0.6, up to 2.5 total of at least one element selected from the group consisting of Nb and Ta;
up to 3Mo;
up to 3Co;
up to 1W;
up to 3Cu;
up to 5Mn;
up to 1Si;
up to 0.15B;
up to 0.05P;
up to 1 total of at least one element selected from the group consisting of Y, La, Ce, Hf, and Zr;
<0.3 Ti+V;

<0.03N; and, balance Fe, wherein the weight percent Fe is greater than the weight percent Ni, and wherein said alloy forms an external continuous scale comprising alumina, and a stable essentially single phase FCC austenitic matrix microstructure, said austenitic matrix being essentially delta-ferrite free and essentially BCC-phase-free.

According to yet another embodiment of the invention, an austenitic stainless steel alloy consists essentially of, in weight percent ranges:

0.2-0.4C;

23-27Ni;

13-1.5Cr;

3.0-4Al;

greater than 0.9, up to 1 total of at least one element selected from the group consisting of Nb and Ta;

up to 3Mo;

up to 3Co;

up to 1W;

up to 3Cu;

up to 5Mn;

up to 2Si;

up to 0.15B;

up to 0.05P;

up to 1 total of at least one element selected from the group consisting of Y, La, Ce, Hf, and Zr;

<0.3 Ti+V;

<0.03N; and, balance Fe, wherein the weight percent Fe is greater than the weight percent Ni, and wherein said alloy forms an external continuous scale comprising alumina, and a stable essentially single phase FCC austenitic matrix microstructure, said austenitic matrix being essentially delta-ferrite free and essentially BCC-phase-free.

The Ni weight percentage in another embodiment is about 2.5Ni, the Cr weight percentage is about 14Cr, the Al weight percentage is about 3.5Al, and the Nb/Ta weight percentage is about 0.95.

A method for casting stainless steel articles is performed by providing a mixture of 0.15-0.5C; 8-37Ni; 10-25Cr; 2.5-5Al; greater than 0.6, up to 2.5 total of at least one element selected from the group consisting of Nb and Ta; up to 3Mo; up to 3Co; up to 1W; up to 3Cu; up to 15Mn; up to 2Si; up to 0.15B; up to 0.05P; up to 1 total of at least one element selected from the group consisting of Y, La, Ce, Hf, and Zr; <0.3 Ti+V; <0.03N; and, balance Fe, wherein the weight percent Fe is greater than the weight percent Ni.

The mixture is heated to above its melting point, typically greater than 1250-1300° C. dependent on exact composition. The molten alloy is then cast, either under vacuum or open to air or an inert cover gas such as Argon. The alloy forms an external continuous scale when exposd to oxidizing conditions from about 500-1000° C., typically 600-900° C. target use temperature comprising alumina, and a stable essentially single phase FCC austenitic matrix microstructure, the austenitic matrix being essentially delta-ferrite free and essentially BCC-phase-free.

Initial experiments were performed on specimens from vacuum arc cast material. Creep tests were conducted at 750° C., 100 MPa. Oxidation resistance was evaluated at 800° C., 10 vol. % water vapor. Predictions of phase equilibria and Scheil simulations were performed using J-Mat Pro 4.1 with a Ni—Fe database.

For service in the temperature range 650° C.-800° C., superior oxidation resistance was associated with an alloy containing larger Nb content in the as-solidified matrix and with aluminum content greater than 2.5 wt. %.

A study of a baseline AFA alloy (AFA 17 in Table 1 (FIG. 6), FIGS. 1 and 2) was performed to look at the effects of Al, Cr, Si, B, and C additions on oxidation resistance (alloys AFA18-AFA22). Increasing silicon from 0.15 to 0.4 wt % had a small positive effect and increasing Al from 3 to 4 wt. % a major positive effect on oxidation resistance (FIGS. 1 and 2). It was unexpectedly found that increasing B and C additions also significantly improved oxidation resistance (FIGS. 1 and 2), as these additions were expected to degrade oxidation resistance. High levels of C and B were anticipated to excessively tie up key alloying additions such as Cr and Nb as carbides or borides, which would detrimentally impact the ability to establish the desired continuous alumina oxide scale. Therefore wrought AFA alloys can gain increased oxidation resistance by increased C content.

Table 2 (FIG. 7) shows compositions for two earlier generation wrought AFA alloys, HTUPS 4 and OC-4, and six new developmental cast compositions CAFA 1-6. As-cast forms of HTUPS 4 and OC-4 were manuthctured. Their oxidation behavior is shown in FIG. 3 and creep behavior in FIG. 4. As can be seen, the as-cast structure of HTUPS 4 resulted in significantly degraded oxidation resistance (FIG. 3). Creep resistance was also significantly degraded relative to wrought HTUPS 4 with 10% cold work (FIG. 4). It is noted that cold work enhances creep resistance in AFA alloys by favoring MC carbide precipitation, wrought HTUPS 4 without cold work would have roughly ½ the creep rupture life under these conditions of 750C and 100 MPa, ~11.00 h. rupture life, which is still double the ~500 h life the cast HTUPS 4. For the OC-4 composition, the cast form exhibited good oxidation resistance (FIG. 3) but moderately degraded creep resistance (FIG. 4). As this alloy composition is optimized more for oxidation than creep resistance, the further decrease in creep resistance for as-cast structure rendered unacceptable results. Therefore, as-cast versions of existing AEA compositions did not result in enhanced properties.

The creep and oxidation resistance of as-cast CAFA 1 and CAFA 4 show the benefit of higher levels of C, and delineate a new composition range of unexpectedly good properties for as-cast AFA alloys. These compositions used very high levels of C, either 0.2 or 0.3 wt. % C, based on the unexpected finding of enhanced oxidation resistance with increased C levels. Particularly at higher temperatures, 750° C. and 800° C. CAFA1 (0.2C) and CAFA 4 (0.3C) also showed outstanding creep with increased C content. For example, with CAFA 4 the creep rupture lifetime at 800° C. and 70 MPa is twice that for the high Ni commercial alloy 120, with Fe-37Ni-25Cr base. A higher Ni content equates to greater alloy cost. This improvement in creep was achieved while still maintaining good oxidation resistance (FIG. 3), again surprisingly improving with increased C content, and opens up numerous potential applications for complex shaped engine and turbine components, as well as cast tubing forms.

The CAFA 2, which is CAFA 1 with increased Si from 1 to 2 wt. %, and CAFA 3, which is CAFA 1 with increased Nb from 0.95 to 2.5 wt. %, resulted in a significant degradation in creep rupture life compared to CAFA 1 (FIG. 4). Charpy impact toughness measurements of CAFA 1 and CAFA 4 yielded 47 J/cm$^2$ for CAFA 1 at 0.2C. compared to 31 J/cm$^2$ for CAFA 4. These values are acceptable for use but indicate a loss in toughness with increasing C content. These behavior patterns frame the acceptable C range for the cast AFA alloys, which are estimated to be limited to around 0.5C wt. %, with 0.2-0.4C, 1 wt. % Si, 1 wt % Nb range optimal.

A limiting factor for AFA alloys is sensitivity to nitrogen impurity levels, due to formation of coarse AlN particles which can degrade creep and oxidation resistance. Vacuum arc-casting yields low levels of O and N impurities, typically less than 0.001 to 0.005 wt. %. However, to achieve low cost manufacturing, for some application casting in air rather than vacuum may be preferred.

Creep rupture data for air cast CAFA 1 (FIG. 3) show a 4× decreased rupture life at 750C and 100 MPa. The air casting resulted in 0.025 wt. % N in the alloy. The nitrogen level in AFA alloys for air casting is generally on the order of 0.02-0.03 wt. % N, which is effectively the maximum tolerance of these alloys for N without excessively severe loss of creep and oxidation resistance.

Higher Si and higher Nb content hurt creep in CAFA 2 and 3 (FIG. 4). Improved creep characteristics are shown for CAFA 1 and CAFA 4, especially at higher temperatures, 750-800° C. (FIGS. 4 and 5). No benefit was found for cast OC-4 and cast HTUPS 4 (FIG. 4), and actually worse for oxidation with cast HTUPS 4 (FIG. 3). FIG. 3 also shows that with higher C content the cast AFA show good oxidation characteristics, which was not expected. Toughness decreases significantly with increased C content as demonstrated by the data for CAFA 1 and CAFA 4 at 0.2 and 0.3C, and again at the highest C level (CAFA 5 and 6) of around 0.4-0.5C. Results indicate that C at these levels does not deteriorate oxidation resistance, which was unexpected.

Tolerance to nitrogen can be achieved by addition of more nitrogen active alloy additions than Al. Based on thermodynamic assessment, Hf. Ti, and Zr can be used to selectively getter N away from Al. The addition of Hf and Zr generally also offers further benefits for oxidation resistance via the well known reactive element effect, at levels up to 1 wt. %. Higher levels can result in internal oxidation and degraded oxidation resistance. Studies of AFA alloys have indicated degradation in oxidation resistance of AFA alloys with Ti and, especially. V additions or impurities, and has indicated limiting these additions to no more than 0.3 wt. % total. Assuming stoichiometric TiN formation, with 0.3 wt. % Ti up to around 0.07 wt. % N is possible, which is sufficient to manage and tolerate the N impurities encountered in air casting. A complication is that Ti will also react with C (as will Nb). Therefore, some combination of Hf or Zr and Ti is desirable to manage and tolerate N effectively.

It is to be understood that while the invention has been described in conjunction with the preferred specific embodiments thereof, that the foregoing description as well as the examples which follow are intended to illustrate and not limit the scope of the invention. Other aspects, advantages and modifications within the scope of the invention will be apparent to those skilled in the art to which the invention pertains.

What is claimed is:

1. An austenitic iron base alloy consisting essentially of, in weight percent ranges:

0.15-0.5C;
8-37Ni;
10-25Cr;
2.5-5Al;
greater than 0.6, up to 2.5 total of at least one element selected from the group consisting of Nb and Ta;
up to 3Mo;
up to 3Co;
up to 1W;
up to 3Cu;
up to 15Mn;
up to 2Si;
0.007-0.15B;
up to 0.05P;
up to 1 total of at least one element selected from the group consisting of Y, La, Ce, Hf, and Zr;
<0.3 Ti+V;
<0.03N; and,
balance Fe, wherein the weight percent Fe is greater than the weight percent Ni, and wherein said alloy forms an external continuous scale comprising alumina, and a stable essentially single phase FCC austenitic matrix microstructure, said austenitic matrix being essentially delta-ferrite free and essentially BCC-phase-free.

2. The austenitic iron base alloy of claim 1, wherein the C weight percent range is 0.2-0.5C.

3. The austenitic iron base alloy of claim 1, wherein the C weight percent range is 0.2-0.4C.

4. The austenitic iron base alloy of claim 1, wherein the Cr weight percent range is 10-15Cr.

5. The austenitic iron base alloy of claim 1, wherein the Cr weight percent range is 14-16Cr.

6. The austenitic iron base alloy of claim 1, wherein the Ni weight percent range is 15-30Ni.

7. The austenitic iron base alloy of claim 1, wherein the Ni weight percent range is 20-30 Ni.

8. The austenitic iron base alloy of claim 1, wherein the Mn weight percent range is 0-5Mn.

9. The austenitic iron base alloy of claim 1, wherein the Ni weight percent range is 8-12 Ni and the Mn weight percent range is 5-15.

10. The austenitic iron base alloy of claim 1, wherein the Si weight percent range is up to 1 Si.

11. The austenitic iron base alloy of claim 1, wherein the Nb/Ta weight percent range is greater than 0.9, up to 2.5 total of at least one element selected from the group consisting of Nb and Ta.

12. An austenitic iron base alloy consisting essentially of in weight percent ranges:

0.4C;
23-27Ni;
13-15Cr;
3.0-4Al;
greater than 0.9, up to 1 total of at least one element selected from the group consisting of Nb and Ta;
up to 3Mo;
up to 3Co;
up to 1W;
up to 3Cu;
up to 5Mn;
up to 2Si;
0.007-0.15B;
up to 0.05P;
up to 1 total of at least one element selected from the group consisting of Y, La, Ce, Hf, and Zr;
<0.3 Ti+V;
<0.03N; and,
balance Fe, wherein the weight percent Fe is greater than the weight percent Ni, and wherein said alloy forms an external continuous scale comprising alumina, and a stable essentially single phase FCC austenitic matrix microstructure, said austenitic matrix being essentially delta-ferrite free and essentially BCC-phase-free.

13. The austenitic iron base alloy of claim 1, wherein the Ni weight percentage is about 2.5Ni, the Cr weight percentage is about 14Cr, the Al weight percentage is about 3.5Al, and the Nb/Ta weight percentage is about 0.95 total of at least one element selected from the group consisting of Nb and Ta.

14. A method of making iron base alloy articles, comprising the steps of:

providing, in weight percent ranges:
0.15-0.5C;
8-37Ni;

10-25Cr;
2.5-5Al;
greater than 0.6, up to 2.5 total of at least one element selected from the group consisting of Nb and Ta;
up to 3Mo;
up to 3Co;
up to 1W;
up to 3Cu;
up to 15Mn;
up to 2Si;
0.007-0.15B;
up to 0.05P;
up to 1 total of at least one element selected from the grou consisting of Y, La, Ce, Hf, and Zr;
<0.3 Ti+V;
<0.03N; and,
balance Fe, wherein the weight percent Fe is greater than the weigh percent Ni, and wherein said alloy forms an external continuous scale comprising alumina, and a stable essentially single phase FCC austenitic matrix microstructure, said austenitic matrix being essentially delta-ferrite free and essentially BCC-phase-free;
heating said mixture;
cooling said mixture to solidify the mixture to form a solid alloy.

15. The method of claim 14, wherein said heated mixture is cast prior to cooling.

* * * * *